US009035797B2

(12) United States Patent
Varma

(10) Patent No.: US 9,035,797 B2
(45) Date of Patent: May 19, 2015

(54) INTELLIGENT TRAFFIC ALERTING AND CONTROL SYSTEM

(76) Inventor: Maya Varma, Cupertino, CA (US)

( * ) Notice: Subject to any disclaimer, the term of this patent is extended or adjusted under 35 U.S.C. 154(b) by 0 days.

(21) Appl. No.: 13/416,861

(22) Filed: Mar. 9, 2012

(65) Prior Publication Data

US 2014/0191882 A1 Jul. 10, 2014

Related U.S. Application Data

(60) Provisional application No. 61/450,668, filed on Mar. 9, 2011.

(51) Int. Cl.

| | |
|---|---|
| ***G08G 1/09*** | (2006.01) |
| ***G08G 1/0967*** | (2006.01) |
| ***G08G 1/01*** | (2006.01) |

(52) U.S. Cl.

CPC ..... *G08G 1/096783* (2013.01); *G08G 1/0104* (2013.01); *G08G 1/0108* (2013.01); *G08G 1/096716* (2013.01); *G08G 1/096725* (2013.01); *G08G 1/096758* (2013.01)

(58) Field of Classification Search

CPC ..... G08G 1/0104; G08G 1/0108
USPC ..... 340/903, 905
See application file for complete search history.

(56) References Cited

U.S. PATENT DOCUMENTS

| | | | | |
|---|---|---|---|---|
| 2007/0222638 | A1* | 9/2007 | Chen et al. | 340/901 |
| 2007/0296610 | A1* | 12/2007 | Heffernan | 340/932 |
| 2008/0198038 | A1* | 8/2008 | Yingst et al. | 340/908 |
| 2010/0073194 | A1* | 3/2010 | Ghazarian | 340/901 |
| 2011/0098898 | A1* | 4/2011 | Stahlin et al. | 701/70 |
| 2012/0026014 | A1* | 2/2012 | Miller et al. | 340/929 |

* cited by examiner

*Primary Examiner* — Hai Phan
*Assistant Examiner* — Zhen Y Wu
(74) *Attorney, Agent, or Firm* — Ryder, Lu, Mazzeo & Konieczny, LLC; Douglas J. Ryder

(57) ABSTRACT

A system to alert drivers approaching a traffic intersection controlled by a traffic signal light. The system may alert about an impending change in the state of the signal from green to red, to allow them to plan ahead and stop the vehicle safely. The system can be used to slow down and stop an autonomous vehicle (driven by a robot) safely at an intersection. It can also be used to implement "active" or "intelligent" stop signs that warn the driver if the vehicle does not slow down when it has crossed the safe stopping distance at an intersection. It may be used as a virtual hazard warning system to warn motorists of temporary hazards or bottlenecks on the roadway; or as an aid for visually impaired drivers (drivers with color blindness, partially or fully blind drivers).

16 Claims, 10 Drawing Sheets

INTELLIGENT TRAFFIC ALERTING AND CONTROL SYSTEM

PRIORITY

This application claims the priority under 35 USC §119 of Provisional Application 61/450,668 entitled "An Intelligent Traffic alerting device and Control System for Manually-Driven and Autonomous Vehicles" filed on Mar. 9, 2011 and having Maya Varma as inventor. Application 61/450,668 is herein incorporated by reference in its entirety but is not prior art.

BACKGROUND

It has been estimated that, at any given time during the day, more than 800,000 vehicles in the United States are being driven by a person using a cell phone. Today's drivers use a variety of hand-held devices, such as cell phones, MP3 players, personal digital assistants, and navigation devices, when they are behind the wheel. While there are laws limiting the use of hands in operating these devices, research has shown that the cognitive distraction in using these devices is significant enough to degrade a driver's performance, even when using hands-free devices.

According to the National Highway Traffic Safety Association (NHTSA) statistics, 5,474 people were killed in crashes involving driver distraction in 2009, which was 16% of the total fatalities. Additionally, the proportion of fatalities reportedly associated with driver distraction increased from 10 percent in 2005 to 16 percent in 2009. During that time, fatal crashes with reported driver distraction also increased from 10 percent to 16 percent. Furthermore, an estimated 20 percent of 1,517,000 injury crashes in 2009 were reported to have involved distracted driving. The increased use of devices such as smart phones for texting and talking is the likely culprit behind these alarming statistics.

What is needed is a system, device and method for alerting drivers to upcoming traffic conditions, such as red lights, stop signs, traffic jams, road conditions or the like.

SUMMARY

This invention aims to improve safety at traffic intersections controlled by traffic lights by alerting drivers approaching the intersection about an impending change in the state of the signal from green to red, to allow them to plan ahead and stop the vehicle safely. The same system can be used when the vehicle is driven by a robot, to slow down and stop the vehicle safely at the intersection. It can also be used to implement "active" or "intelligent" stop signs that warn the driver if the vehicle does not slow down when it has crossed the safe stopping distance at an intersection; as a virtual hazard warning system to warn motorists of temporary hazards or bottlenecks on the roadway; or as an aid for visually impaired drivers (drivers with color blindness, partially or fully blind drivers).

BRIEF DESCRIPTION OF THE DRAWINGS

The features and advantages of the various embodiments will become apparent from the following detailed description in which.

DETAILED DESCRIPTION

Figure 1A:
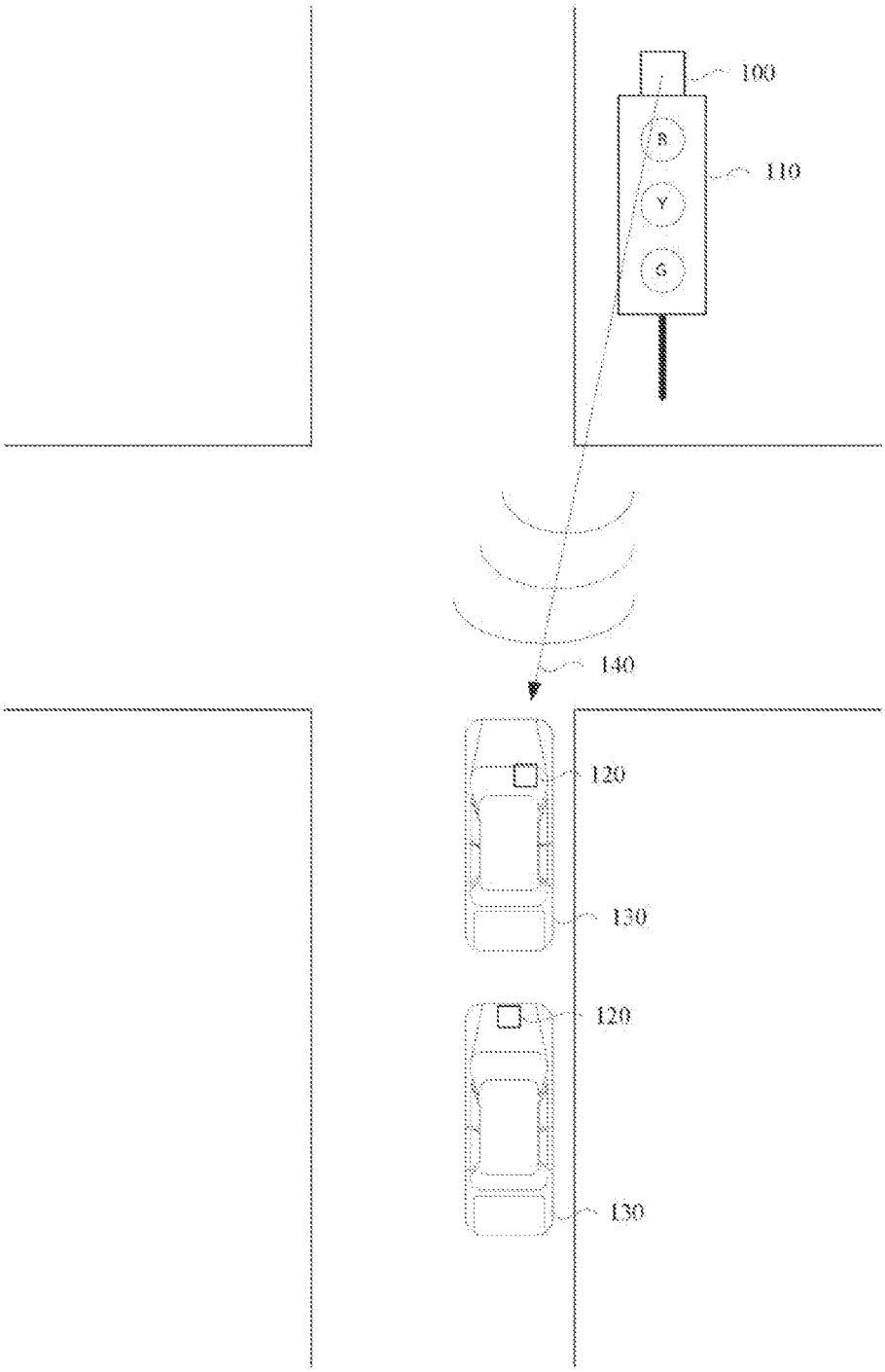
FIGS. 1A-B illustrate example traffic alerting device systems utilized at an intersection controlled by different traffic alerting devices, according to one embodiment.

FIG. 1A illustrates an example traffic alerting device system utilized at an intersection controlled by a traffic signal. For simplicity and ease of understanding only a single traffic signal and traffic in one direction associated with the traffic signal is illustrated. The traffic alerting device system includes a transmitter module 100 that is mounted on, or integrated with, the traffic signal 110 and a receiver module 120 located in, or integrated with, vehicles 130. The transmitter module 100 may periodically generates messages 140 that may contain information on the type of intersection, its location, its orientation with respect to the approaching vehicle, and the time for the signal to turn to red. The transmitter module 100 may transmit the message 140, for example as a radio frequency (RF) signal, in the direction of the oncoming traffic. The messages 140 are received by the receiver module 120 in the vehicles 130 in the vicinity of the intersection. The receiver module 120 may processes the messages 140 and determine if and when to alert the driver of an upcoming red signal to enable the driver to make a safe stop when necessary.

It should be noted that the location of the transmitter module 100 on the traffic signal 110 and the receiver module 120 in the vehicle 130 is in no way limited to the locations illustrated. Rather, the transmitter module 100 and the receiver module 120 are functional units that may be one or more stand alone components, may be integrated with other components in the traffic signal 110 and the vehicle 130 respectively, or some combination thereof without departing from the current scope.

The traffic alerting device system is not limited to being used with traffic signals 110 at four way intersections as illustrated. Rather, the system could be implemented on traffic signals 110 at any type of intersection without departing from the current scope. In fact the system is not limited to use with traffic signals 110. Rather the system can be used to provide information from various types of traffic alerting devices, including but not limited to stop signs, traffic advisory signs (e.g., curved road, steep hill, merge), and electronic traffic advisory signs. The messages generated and transmitted may be associated with the traffic alerting device system it is associated with. For example, a stop sign may send messages notifying that the stop sign is approaching.

Figure 1B:
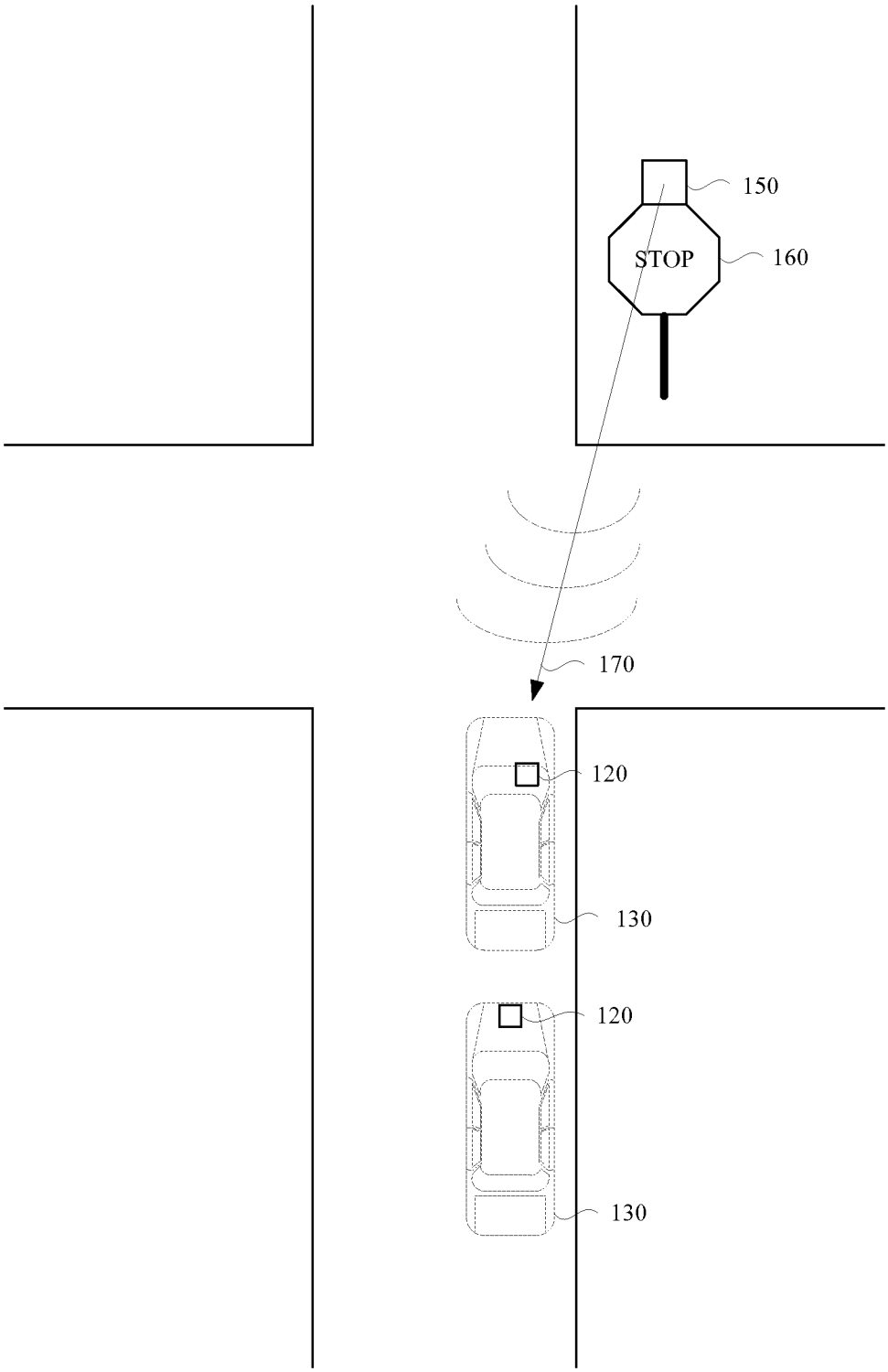

FIG. 1B illustrates an example traffic alerting device system utilized at an intersection controlled by a stop sign 160. A transmitting module 150 is mounted on the stop sign 160. The transmitter module 150 may periodically generate messages 170 that may contain information on the type of intersection, its location, its orientation with respect to the approaching vehicle, and the fact that vehicle is approaching the stop sign 160. The transmitter module 150 may transmit the message 170, for example as RF signal, in the direction of the oncoming traffic.

The receiver module 120 in FIGS. 1A-B is illustrated as being located in vehicles 130 driven by humans. However, it is not intended to be limited thereto. Rather, the receiver module 120 can be included in autonomous vehicles and connect to/interface with robots controlling the operation thereof to provide a sensing input to enable it to pass through the intersection safely.

Figure 2A:
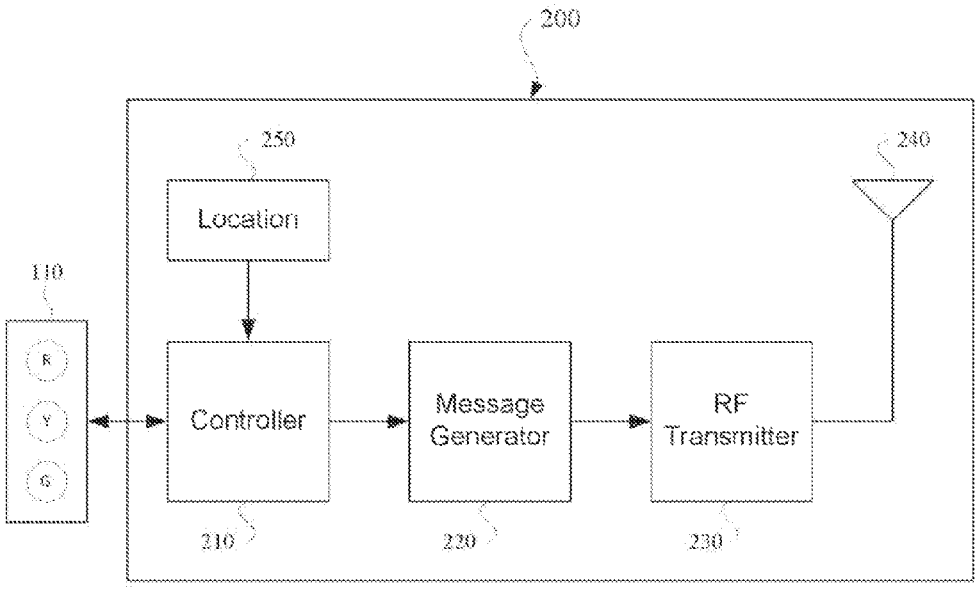
FIGS. 2A-B illustrate block diagrams of example transmitter modules for use with different traffic alerting devices, according to one embodiment.

FIG. 2A illustrates a block diagram of an example transmitter module 200 (e.g., 100 of FIG. 1A) used in traffic signals (e.g., 110 of FIG. 1A). The transmitter module 200 may include a controller (e.g., microcontroller) 210, a message generator 220, an RF transmitter 230, an antenna 240, and a location sensing module 250. The controller 210 is to control the operations of the module 200. The controller 210 may receive information on the state of the signal (red, yellow, green) and the time intervals for each state from the traffic signal 110. The controller 210 may determine when the traffic signal is within a predetermined amount of time from turning red and instruct the message generator 220 to begin generating message. According to one embodiment, the controller 210 may be the same controller (not illustrated) utilized to control the operation of the traffic signal 110.

The message generator 220 may generate the appropriate messages based on input from the controller 210. The messages may include location/orientation information received from the location sensing module 250. The RF transmitter 230 may generate RF signals to encode the messages to be sent to the receivers. The antenna 240 may transmit the messages as RF signals. The location sensing module 250 may be capable of determining the physical location and orientation of the traffic signal 110 the transmitter module 200 is attached to. The location sensing module 250 may include a GPS receiver and/or an electronic compass sensor. Alternately, the location sensing module 250 may be a memory device that has the location/orientation information programmed therein (e.g., by a technician installing the device).

As the transmitter module 200 is installed on, and possibly integrated with, the traffic signal 110, the power for the transmitter module 200 may be provided by the traffic signal 110. Alternatively, the transmitter module 200 may include a battery (not illustrated), a solar array (not illustrated), other power sources, or any combination thereof to provide power and/or as a back-up power source.

The transmitter module 200 is not limited to use with traffic signals. Rather, it could be utilized with any traffic alerting devices where the alerts are changing and there is coordination between the traffic alerting device and the transmitter module 200 with regard to the alerts.

It should be noted that each of the blocks is a functional unit and may or may not be an actual component. Rather, multiple functions may be provided by a single component, multiple components may provide the functions of a single block or some combination thereof. The functions may be provided by hardware, software, firmware or some combination thereof.

Figure 2B:
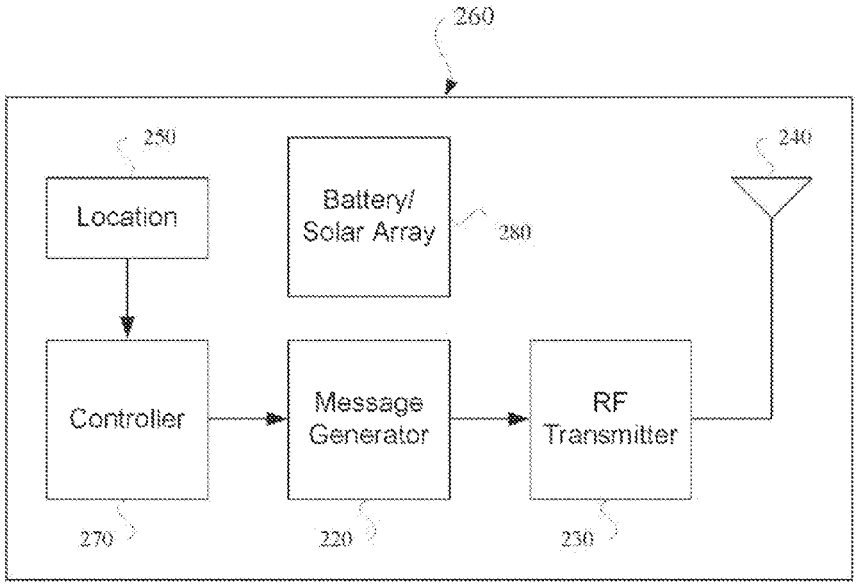

FIG. 2B illustrates a block diagram of an example transmitter module 260 (e.g., 150 of FIG. 1B) used with stop signs (other type of signs, or static traffic alerting device systems). The transmitter module 260 includes many of the same components but the controller 270 does not communicate with the stop sign. As the stop sign likely does not include a power source the transmitter module 260 may also contain a battery, solar cell array, other power sources, or any combination thereof 280 to provide power thereto. Alternatively, the transmitter module 260 may connect to a separate external battery and/or solar cell array 280 to provide power thereto.

Figure 3A:
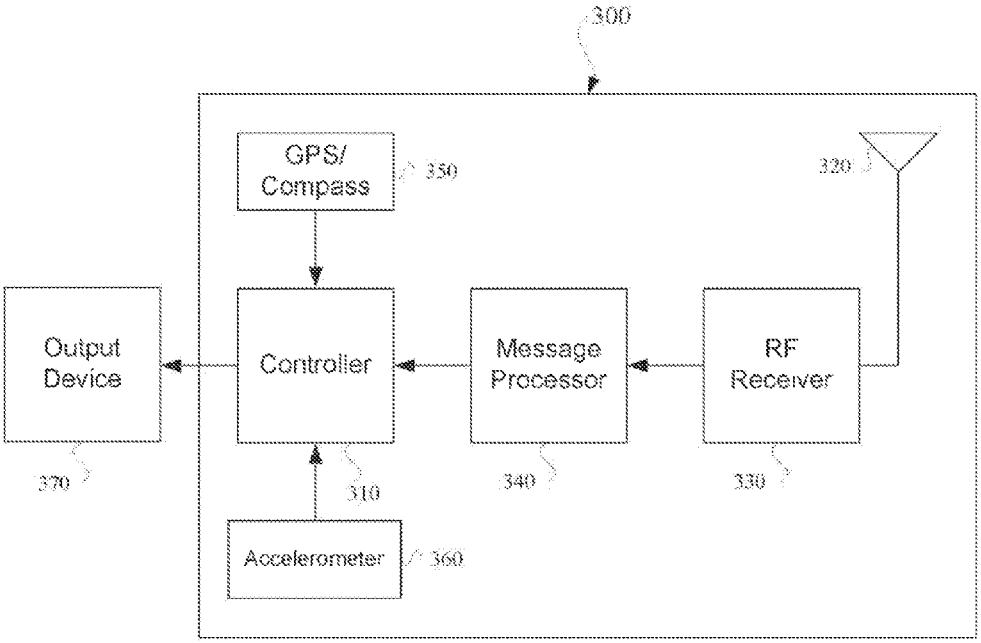
FIGS. 3A-B illustrate block diagrams of example receiver modules for use in vehicles, according to one embodiment.

FIG. 3A illustrates a block diagram of an example receiver module 300 for use in vehicles (manually driven). The receiver module 300 may include a controller (e.g., microcontroller) 310, an antenna 320, an RF receiver 330, a message processor 340, a GPS receiver/digital compass 350, an accelerometer 360, and an output device 370. The controller 310 is to control the actions within the module. The antenna 320 receives messages and the RF receiver 330 extracts/decodes the messages from the RF signals. The message processor 340 extracts the appropriate information (e.g., distance from/location of transmitter, time to change in traffic alerting device system) from the messages and provides the information to the controller 310. In addition to receiving the information extracted from the messages the controller 310 may also receive information related to location and direction of the vehicle from the GPS receiver/digital compass 360 and the speed of the vehicle from the accelerometer 360.

According to one embodiment, the GPS receiver/digital compass 360 and/or the accelerometer 360 may be external components connected and/or interfaced to the receiver module 300. According to one embodiment, the GPS receiver/digital compass 360 and/or the accelerometer 360 may be components of the vehicle (e.g., part of vehicle navigation system) that are connected and/or interfaced to the receiver module 300 and provide the speed, location and/or direction to the receiver module 300. According to one embodiment, the receiver module 300 may be connected and/or interfaced to a controller of the vehicle that may provide various data related to the vehicle, including speed, location and/or direction to the receiver module 300.

The controller 310 may utilize the information extracted from the messages, as well as the speed, location and direction data to determine if and when the vehicle should be provided notifications about the upcoming traffic alerting devices (e.g., traffic signal turning red). If it is determined that a notification should be provided the controller 310 may activate the output device 370. The output device 370 may include audible alerts (e.g., speaker to provide voice alerts, buzzer, alarm) and/or visual alerts (e.g., lights illuminating, messages displayed). The output device 370 may be part of the vehicle (e.g., display device in dashboard, stereo, voice module associated with map or the like in the vehicle, lights in the vehicle). By way of example, a message that states that a red light is upcoming may be displayed on the map module included with the vehicle.

As the receiver module 300 is installed in, and possibly integrated with, the vehicle, the power for the receiver module 300 may be provided by the vehicle. Alternatively, the receiver module 300 may include a battery (not illustrated) and/or a solar array (not illustrated) to provide power and/or as a back-up power source.

Figure 3B:
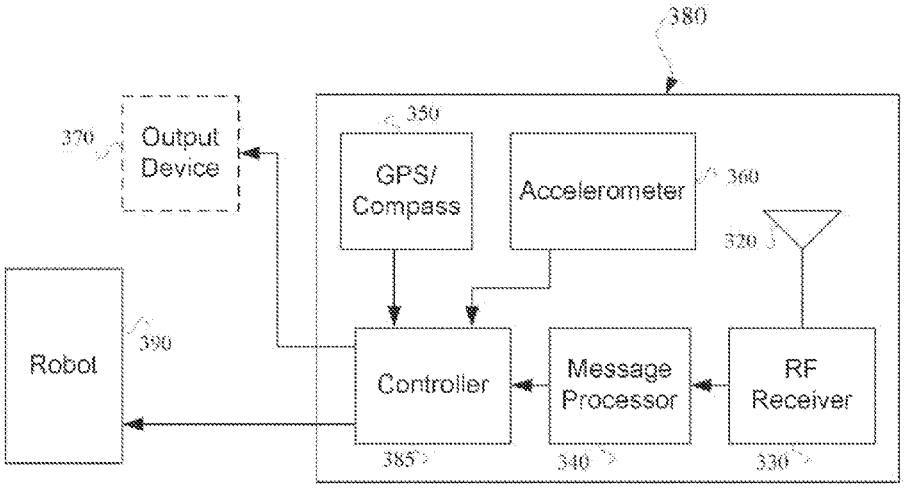

It should be noted that each of the blocks is a functional unit and may or may not be an actual component. Rather, multiple functions may be provided by a single component, multiple components may provide the functions of a single block or some combination thereof. The functions may be provided by hardware, software, firmware or some combination thereof FIG. 3B illustrates a block diagram of an example receiver module 380 for use in an autonomous vehicle. The receiver module 380 includes many of the same components as the receiver module 300. In addition, the controller 385 is to communicate (e.g., send alert messages) with a robot 390 driving the vehicle. According to one embodiment, the speed, direction and/or location information may be provided to the receiver module 380 by the robot 390. According to one embodiment, the robot 380 may already be aware of the speed, direction and/or location information and simply be provided with the information extracted from the messages and determine if and when the output device 370 should be activated or actions should be taken by the robot based on the messages received from the transmitter module of a traffic alerting device.

Figure 4:
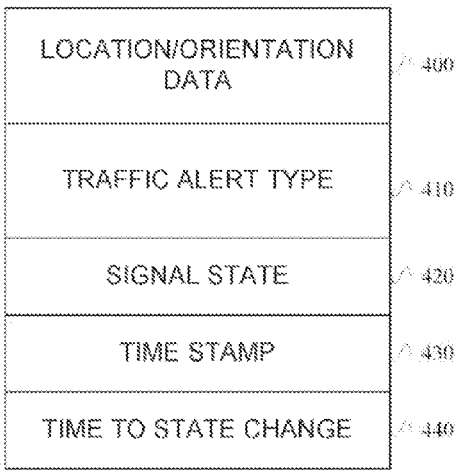
FIG. 4 illustrates example information contained in messages sent from the transmitter module associated with a traffic alerting device, according to one embodiment.

FIG. 4 illustrates example information contained in the messages sent from a transmitter module associated with a traffic alerting device. This information can be sent formatted as self-contained packets, or may be encoded using any technique used to send information over wireless channels. The information in the messages may include location/orientation data 400, traffic alerting device type 410, state of traffic alerting device 420, a time stamp 430, and a time to change (TTC) 440. The location/orientation data 400 may include identifying information such as GPS coordinates, street names/numbers, and direction facing. The identifying information may be obtained with a GPS receiver, mapping program and/or digital compass, may be programmed into memory, or some combination thereof. The traffic alerting device type 410 may identify the traffic alerting device (e.g., traffic light, stop sign, road hazard sign, electronic road sign) that the transmitter module is connected to/integrated with. The data may be provided as part of the communication there between, may be programmed into memory, or some combination thereof.

The state of the traffic alerting device 420 is associated with the current state of traffic alerting devices that change state. For example, for traffic lights this field may indicate whether the traffic signal is red, green, or yellow. This field may be blank or never change for static traffic alerting devices (e.g., stop sign). The timestamp 430 indicates the current time when the message was sent by the transmitter module. The TTC 440 is the time until the current state of the traffic alerting device changes. For example, for traffic lights this field may indicate the time remaining until the next signal change (e.g., green to yellow, yellow to red). The TTC 440 may be limited to certain signal changes (e.g., yellow to red). The TTC 440 must have enough resolution (e.g., a few milliseconds) for the receiver modules to compute the expected position of the vehicle at the end of this interval with necessary precision.

Figure 5:
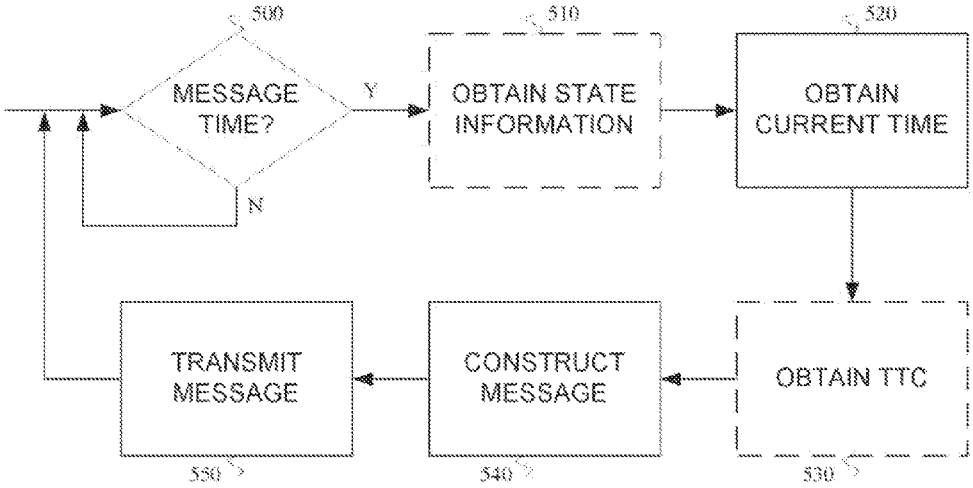
FIG. 5 illustrates a flowchart of example actions performed by a transmitter module associated with a traffic alerting device, according to one embodiment.

FIG. 5 illustrates a flowchart of example actions performed by a transmitter module associated with a traffic alerting device. The transmitter module may perform these actions at periodic intervals, driven by a clock or timer. The periodic interval may be, for example, a few milliseconds. Initially, a determination is made as to whether it is time to prepare the message 500. Once a determination is made that it is time to generate the message (500 Yes), the state of traffic alerting device is obtained 510. It should be noted that this action (510) may only be performed for traffic alerting devices that change state (e.g., traffic signals). As previously noted, there is no state or is only one fixed state for static traffic alerting devices (e.g., stop signs). The transmit module should know whether there is a state to obtain based on the traffic alerting device information that is programmed therein or received thereby. The state of the traffic alerting device may be for example the color (e.g., green, yellow, red) of a traffic signal. The current time may then be obtained 520 along with the time until the current state of the traffic signal changes (TTC) 530. It should be noted that this action (530) may only be performed for traffic alerting devices that change state as there is no state (or is a fixed state) for static traffic alerting devices.

The message is then constructed 540. The message may include the data obtained (510, 520, 530) in addition to location/orientation data for the traffic alerting device and possibly information about the type of traffic alerting device. The message is then transmitted 550 (e.g., as an RF signal). The state of the traffic alerting device 510 and the time until its next change (TTC) 530 may be obtained either from data stored in the transmitter module or from an external controller. The current time 520 may be obtained from an internal clock when the message is transmitted so as to serve as a time stamp for the message.

Figure 6:
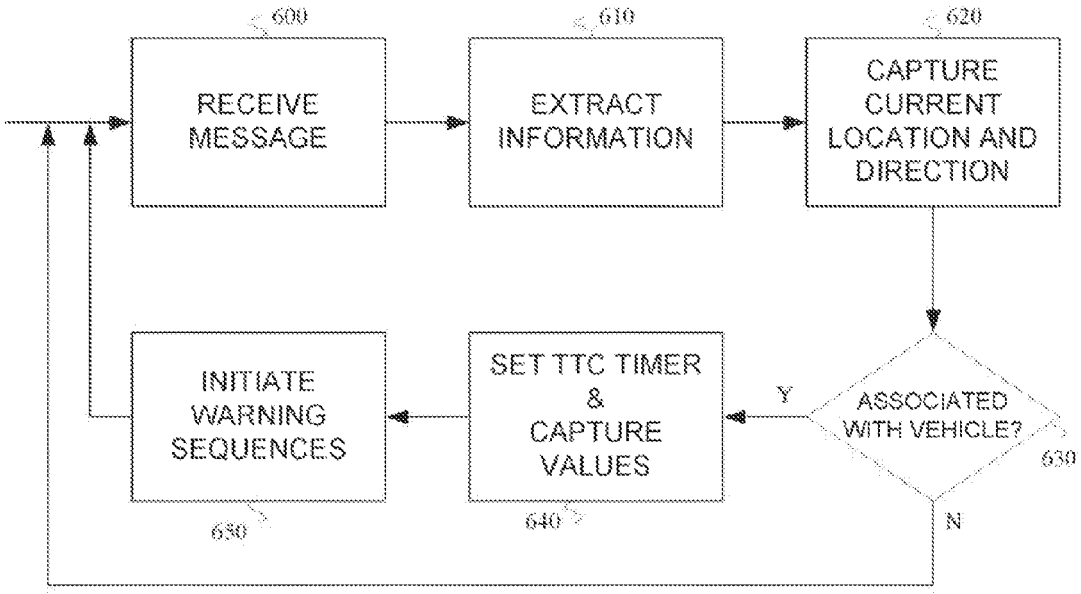
FIG. 6 illustrates a flowchart of example actions performed by a receiver module receiving messages associated with a traffic alerting device, according to one embodiment.

FIG. 6 illustrates a flowchart of example actions performed by a receiver module receiving messages associated with a traffic alerting device. Initially the receiver receives a message 600. The receiver then extracts information from the messages 610. The extracted information may include location/orientation of the transmitter device connected to the traffic alerting device, state of traffic alerting device, time associated with message (time stamp), and TTC from the current state. The current location of the vehicle and the direction it is traveling is then captured 620. Using the location/orientation of the traffic alerting device and the location/direction of the vehicle a determination can be made as to whether the traffic alerting device is on the path of the vehicle (whether the message is associated with the vehicle) 630. If it is determined that the message is not associated with the vehicle (vehicle is not on a path toward traffic signal) 630 No, then no further processing of the message is done and the receiver awaits a next message. If it is determined that the message is associated with the vehicle (vehicle is on a path toward traffic signal) 630 Yes, then a TTC timer is set to TTC value from the message and other values from the message are captured (e.g., current state, type of traffic alerting device) 640. The alert sequences are then initiated to determine if a warning should be initiated and what kind of warning 650.

Figure 7:
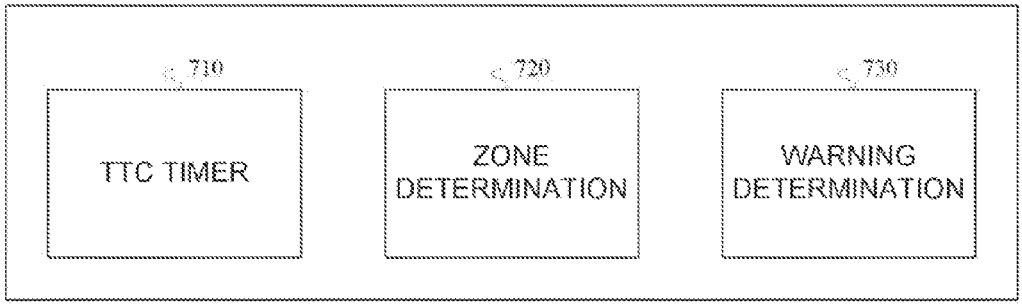
FIG. 7 illustrates a functional block diagram of an example warning sequence, according to one embodiment.

FIG. 7 illustrates a functional block diagram of an example warning sequence 700 (e.g., 650 of FIG. 6). The warning sequence may include, for example, a TTC timer process 710, a zone determination process 720 and a warning determination process 730. The processes 710, 720, 730 may be operated concurrently. The TTC timer process 710 is to keep track of the time remaining until the next state change of the traffic device. The zone determination process 720 is to periodically update the current speed and position of the vehicle relative to the intersection controlled by the traffic signal and to define the zones (e.g., warning zone, brake zone) based thereon. The warning determination process 730 is to warn a driver with an appropriate warning/alert based on the current position of the vehicle and its estimated position when the next signal state change would occur.

Although the TTC (e.g., 530 of FIG. 5) may be communicated within the messages transmitted by the transmitter module, the messages are only transmitted periodically. Thus, maintaining the time to change value based on samples from the messages alone may not provide the adequate resolution to perform the computations within the receiver module to the accuracy required. Furthermore, some messages transmitted by the transmitter module may not be received by the receiver module or may be received with errors, so the receiver module can't count on a minimum frequency to receive the samples of TTC values from the transmitter.

Figure 8:
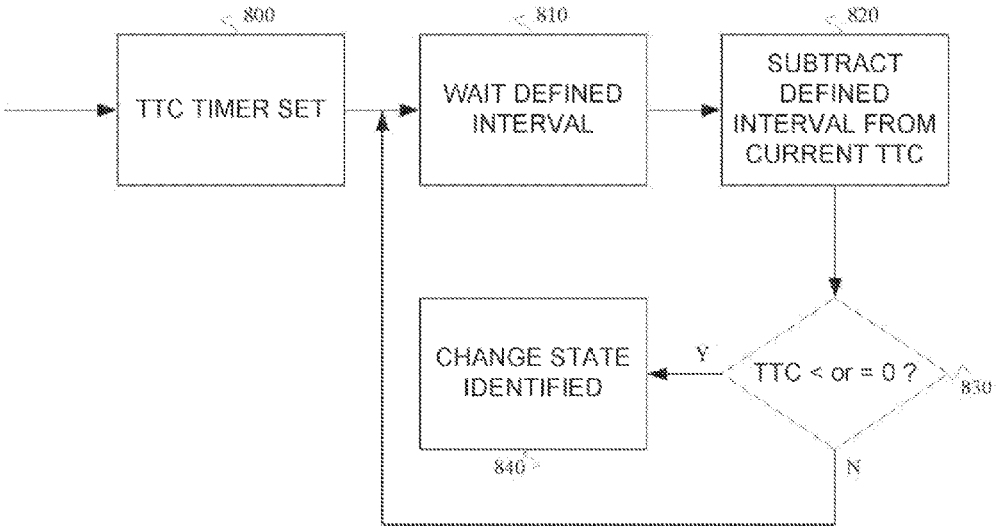
FIG. 8 illustrates a flowchart for an example TTC timer process, according to one embodiment.

FIG. 8 illustrates a flowchart for an example TTC timer process (e.g., 710 of FIG. 7). As noted, this process is responsible for maintaining the time interval to the next state change of the traffic alerting device (e.g., time until traffic signal changes from green light to yellow) in the path of the vehicle. The process may be driven by a free-running local clock in the receiver module. Initially, the process starts when a TTC timer is set based on a message received that is associated therewith 800. The clock may be used to identify defined intervals (e.g., 1 millisecond) 810. The defined interval may be selected based on the level of precision needed for the computations. The precision may be implementation specific. At each interval, the defined interval is subtracted from the current TTC value 820 (new TTC=current TTC−defined interval). Because this update is performed at the defined interval, the TTC value maintained by the receiver will be accurate within the margin of the defined interval.

Upon receiving each error-free message that is associated with the vehicle, the TTC timer is overwritten 640 with the value from the TTC field 440 of the message, so as to avoid the TTC timer deviating from the TTC values transmitted by the traffic alerting device because of the drift of the free-running local clock in the receiver with respect to the clock used by the traffic alerting device.

A determination is made as to whether the TTC timer is at or below zero after the interval is subtracted 830. If the TTC timer is at or below zero 830 Yes the state of the traffic signal is likely to have changed so the state of the traffic signal is changed in the receiver 840. The receiver may make this determination before a message is received that changes the state. In fact, it is possible that the received does not receive a message changing the state if the vehicle is passes the intersection between message transmissions. If the TTC timer is still above zero 830 No, the process continues at 810.

When a new message is received, the TTC value is reset to the value from the message 800. The TTC timer process is responsible for maintaining the TTC value with an accuracy having a margin of error no greater than the defined interval between these refresh points.

Figure 9:
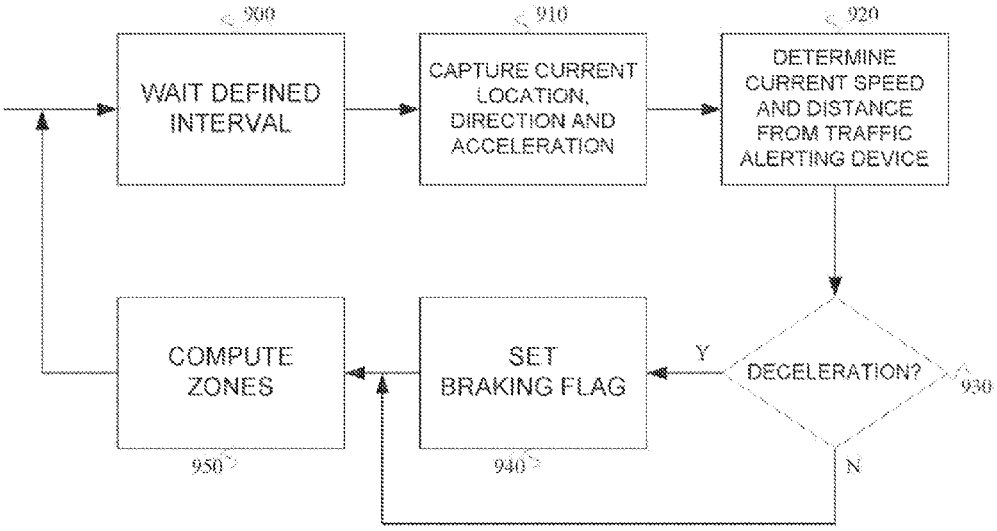
FIG. 9 illustrates a flowchart for an example zone determination process, according to one embodiment.

FIG. 9 illustrates a flowchart for an example zone determination process (e.g., 720 of FIG. 7). As noted above, this process is to periodically update the current speed and position of the vehicle relative to the intersection controlled by the traffic signal and to define the zones (e.g., warning zone, brake zone) based thereon. The process may also be updated at defined intervals 900. The defined interval may be selected based on the level of precision needed for the computations. The defined intervals for the TTC timer process and the zone determination process may be the same. At each defined interval, the current location, direction and acceleration of the vehicle may be captured 910. The location captured may be the current GPS coordinates from a GPS receiver (e.g., 350 of FIGS. 3A-B), the direction may be captured from a digital compass (e.g., 350 of FIGS. 3A-B), and the acceleration may be captured from an accelerometer (e.g. 360 of FIGS. 3A-B). The current speed and the distance from the traffic alerting device (e.g., traffic signal) may then be calculated 920. The current speed can be computed iteratively by adding the quantity (acceleration*defined interval) to the previous speed. The distance may be calculated based on the current location/direction of the vehicle and the location/orientation of the traffic alerting device identified in the message.

A determination may then be made as to whether the vehicle is slowing down rapidly as a result of braking 930. The determination may compare the current value of deceleration (inverse of the acceleration value read from the accelerometer) to a pre-selected threshold value. If the current deceleration is higher than the threshold 930 Yes it is assumed that the vehicle is applying the brake and a braking flag is set 940. The braking flag will be utilized in the warning determination process (e.g., 730 of FIG. 7). Either after the braking flag is set or if the braking flag is not set 930 No the warning zones may be determined based on the current speed of the vehicle 950. The warning zones may include a warning zone where alerts that you should be prepared to stop may be issued and a braking zone where you may be directed to brake.

Figure 10:
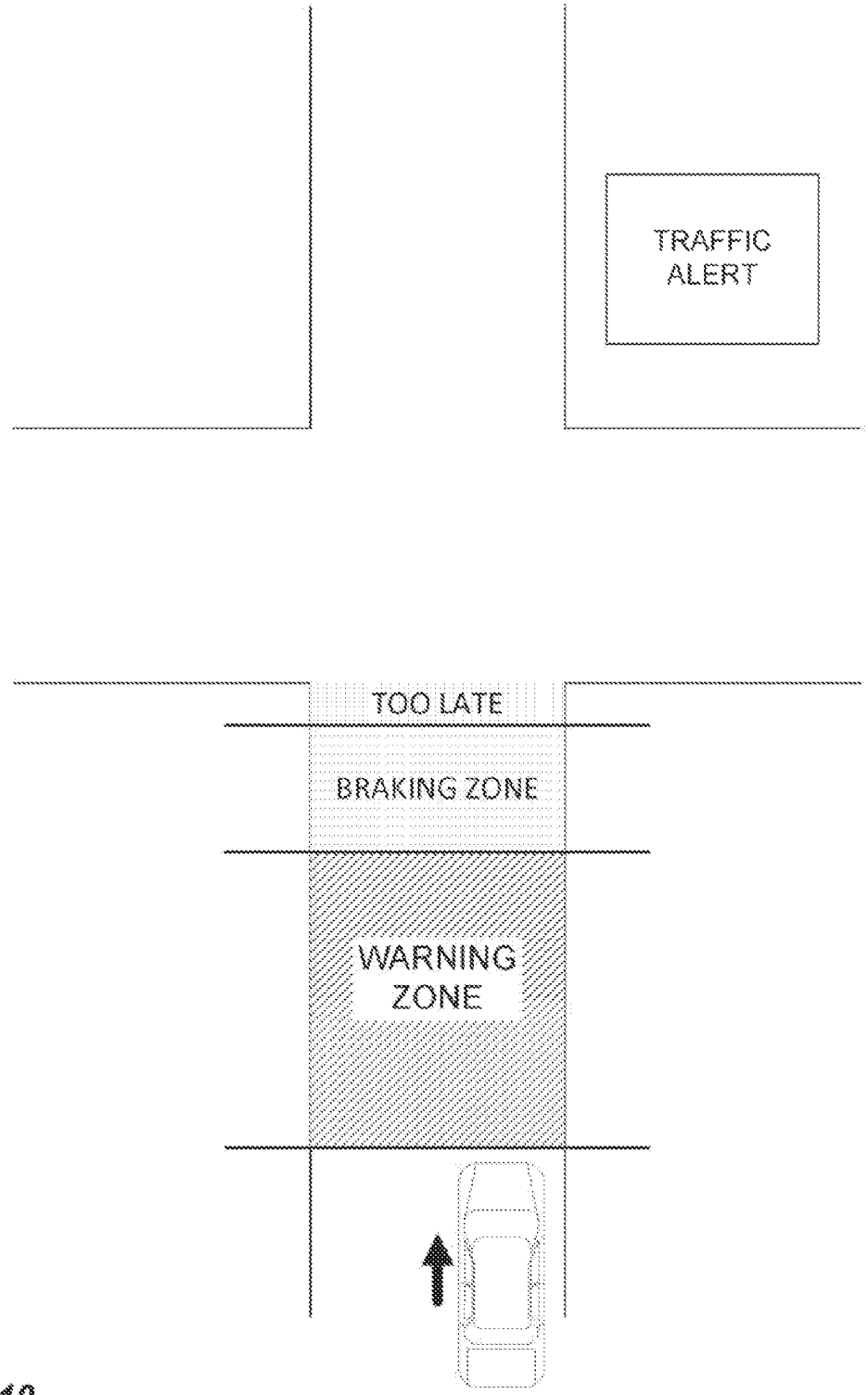
FIG. 10 illustrates example warning zones for an intersection based on speed of the vehicle, according to one embodiment.

FIG. 10 illustrates example warning zones for an intersection based on speed of the vehicle. As illustrated a brake zone is defined and a warning zone is defined. The brake zone may be the region in which you need to apply your brakes in order to safely stop at the intersection. The brake zone may take into account what a safe stopping distance is based on the speed of the vehicle. The stopping distance (SD) may be calculated as $(\text{current speed})^2/2\,\mu g$, where $\mu$ is the coefficient of friction and g is the acceleration due to gravity. The coefficient of friction is dependent on road conditions, the conditions of tires, etc. A value of $\mu=0.8$ may be chosen for good road conditions and good tires. Smaller values may be used to calculate worst-case stopping distances. Alternately, the vehicle may be equipped with sensors to monitor road conditions and/or the conditions of the tires, and these outputs may be used to determine the value for $\mu$. According to one embodiment, SD values for different speeds may be stored in a pre-computed table and these pre-stored values may be utilized to determine the braking zone.

The calculated or looked up SD value may be the center of the braking zone with a buffer added to each side. Alternatively, the center may be based on a selected $\mu$, which the range being based on smaller and bigger $\mu$ values. It should be noted that there will be a point at which it will no longer to possible to safely stop at the intersection based on the current speed.

A warning zone may be created outside of the brake zone. In this zone the driver of a vehicle may be provided with alerts that they should be prepared to stop. The zone may be based on the predicted distance the vehicle will travel in a certain time based on the current speed. For example, if the vehicle is moving at 60 MPH and you want to warn the driver 3 seconds prior to the braking zone the driver would begin to receive messages 0.05 miles prior to that {(60 miles/hour)*(1 hour/3600 seconds)*(3 seconds)}. Alternately, the warning zone may be chosen using other implementation-specific means.

Figure 11A:
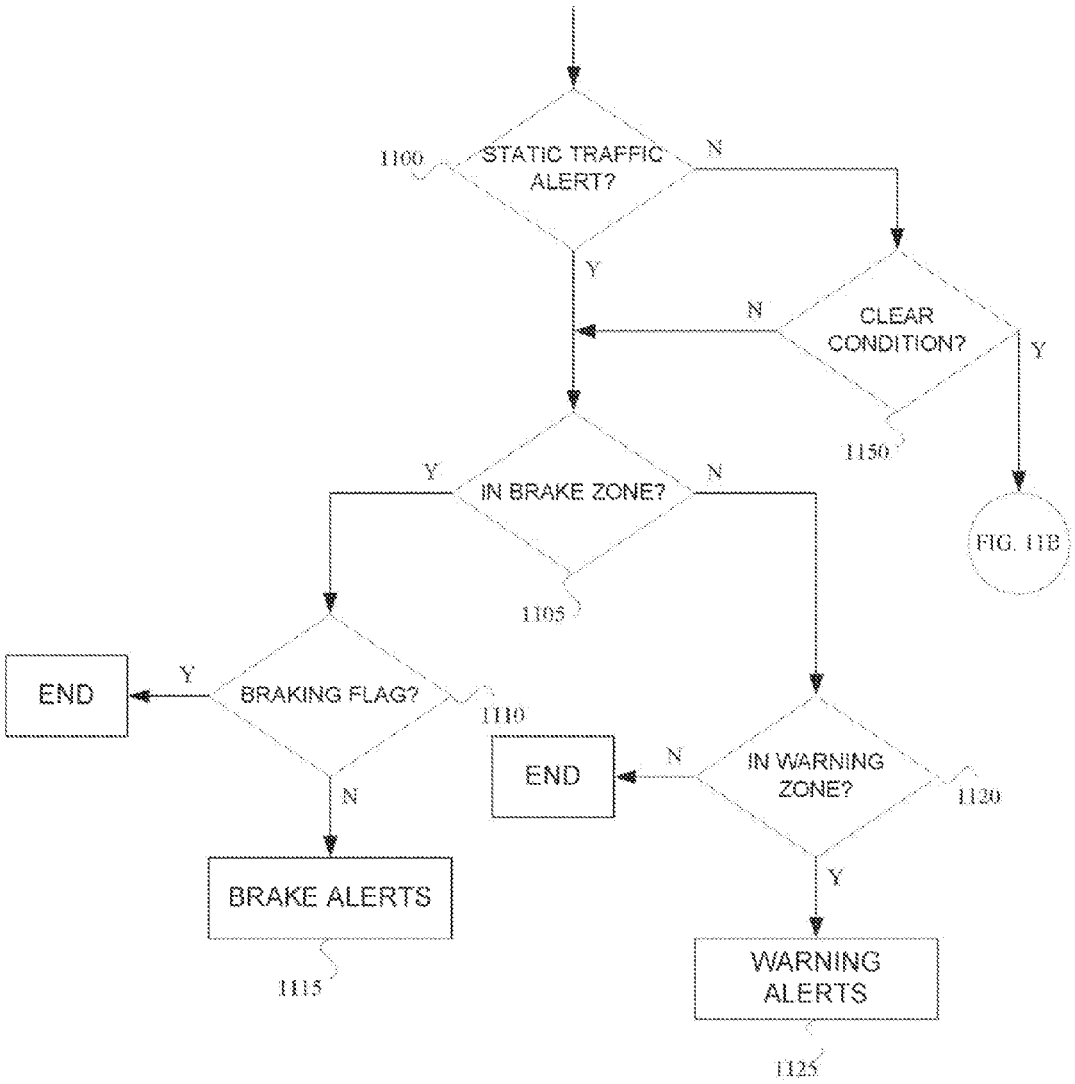
FIGS. 11A-B illustrate flowcharts for an example warning determination process, according to one embodiment.
Figure 11B:
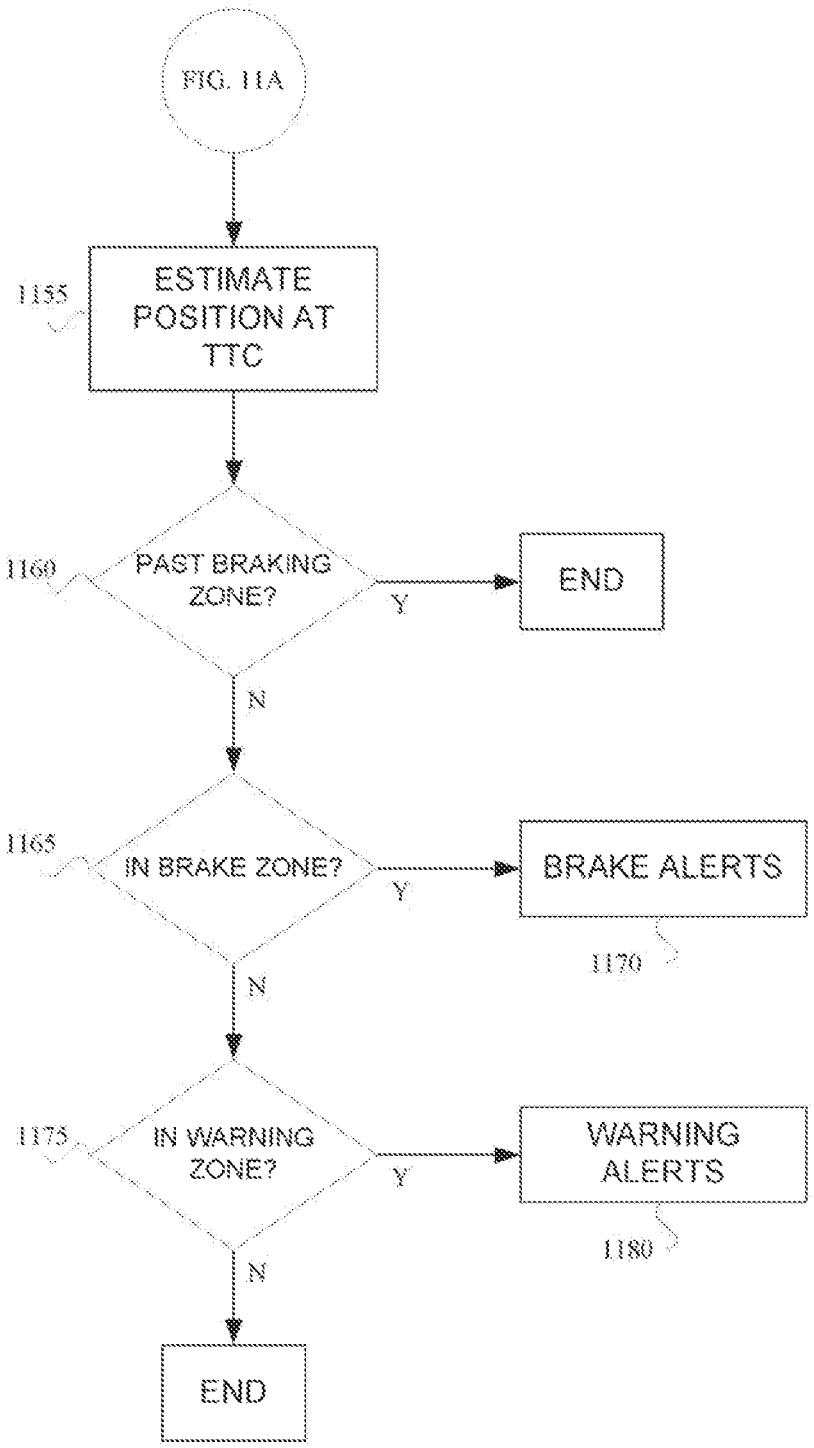

FIGS. 11A-B illustrate flowcharts for an example warning determination process (e.g., 730 of FIG. 7). This process runs continuously when one or more messages have been received by the receiver module. Initially a determination is made as to whether the traffic alerting device that the message was sent from is a static traffic alerting device (e.g., a stop sign) 1100. If it is determined that the message came from a static traffic alerting device 1100 Yes a determination is made as to whether the current location of the vehicle is within the brake zone 1105. If it is determined that the vehicle is currently in the brake zone 1105 Yes a determination is made as to whether the brakes are being applied (the braking flag is set) 1110. If a determination is that the brakes are being applied 1110 Yes no further action is taken. If the determination is that the brakes are not being applied 1110 No then the brake alerts are provided 1115.

If the determination is that the vehicle is not currently in the brake zone 1105 No then a determination is made as to whether made the current location of the vehicle is within the warning zone 1120. If it is determined that the vehicle is currently in the warning zone 1120 Yes then the warning alerts are provided 1125. If a determination is that the vehicle is not currently in the warning zone 1120 No then no further action is taken.

If the determination was that the traffic alerting device was not a static traffic alerting device but was rather a dynamic traffic alerting device (e.g., traffic signal light) 1100 No then a determination is made as to whether the current status of the traffic alerting device is clear (e.g., green light) 1150. If the determination is that the dynamic traffic alerting device is not in a clear condition (e.g., red light, yellow light) 1150 No then the process proceeds like it did for the static traffic alerting device. If the determination is that the dynamic traffic alerting device is in a clear condition (e.g., green light) 1150 Yes, then the position of the vehicle when the TTC timer expires and the current state of the traffic alerting device changes (e.g., to red) is estimated 1155. A determination is made as to whether the estimated position is past the braking zone 1160. If the determination is that the position of the vehicle will be past the braking zone 1160 Yes it is too late to brake and no further action will be taken.

If the determination is that the vehicle will not be past the braking zone 1160 No a determination is made as to whether the vehicle will be in the braking zone 1165. If the determination is that the vehicle is in the braking zone 1165 Yes the braking alerts will be activated 1170. If the determination is that the vehicle will not be in the braking zone 1165 No a determination is made as to whether the vehicle will be in the warning zone 1175. If the determination is that the vehicle is in the warning zone 1175 Yes the warning alerts will be activated 1180. If the determination is that the position of the vehicle will not be in the warning zone 1175 No the vehicle is too far out and no further action will be taken.

The various processes for the receiver described above (e.g., FIGS. 6, 8, 9 and 11) may be modified to include additional functionality. For example, for use in an autonomous vehicle by making it provide appropriate sensory inputs to the robot driving the vehicle, instead of audible or visual prompts and alarms. When multiple traffic alerting devices are present in close proximity to each other, the transmitted RF signals from the transmitter modules associated with them may interfere with each other. This can be avoided by the use of a channel access mechanism typically used on shared wireless channels for medium access control. When multiple traffic, according to one embodiment are present on the path of the vehicle (for example, a traffic light and a stop sign beyond that), the receiver module needs to prioritize the messages received from the traffic device closer to the vehicle.

A potential application of the system, beyond those stated above, is its use as a virtual hazard warning system to warn motorists of temporary hazards or bottlenecks on the roadway. In this case, the transmitter module will be part of a hand-carried device (portable sign) that can be activated any time to warn motorists of temporary hazards or bottlenecks. The transmitter module can be carried by emergency personnel and activated very quickly. Thus, it serves as a virtual yellow "road closed" warning sign for approaching drivers. The receiver module can also be modified to receive warning signs from electronic message boards mounted on the side of the roadways and convert them into voice or other forms of visual/auditory messages. The transmitter module in this case will be part of the message board.

Another application is its use as an aid for visually impaired drivers (drivers with color blindness, partially or fully blind drivers). In this case, the alerts from the receiver module can be converted into a non-visual sensory cue (such as vibrations of the seat) to alert or warn the driver.

Such as device can also be used to monitor traffic violations (red light running, unsafe stopping, etc.). In this application, the receiver device will be activated by a monitoring authority (employer of the driver, parent of a teen driver, etc.) The receiver device will log the signal state at each intersection during a trip into an electronic file, and this file can be read and analyzed by the supervisor to look for unsafe driving behaviors.

Although the disclosure has been illustrated by reference to specific embodiments, it will be apparent that the disclosure is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed:

1. A traffic alerting and control device in communication with a vehicle, the device comprising a receiver to receive messages associated with a traffic alerting device, wherein the messages include information related to the traffic alerting device including location of the traffic alerting device and a time until a current state of the traffic alerting device changes;

a location sensing module to determine location and direction of the vehicle;

a speed sensing module to determine speed of the vehicle; and a controller to extract information from the messages;

determine when the messages are associated with the vehicle based on path of the vehicle and location of the traffic alerting device;

determine braking zone and warning zone based on the speed of the vehicle, wherein the braking zone is a range of distances from the traffic alerting device in which brakes can be applied to safely stop the vehicle and the warning zone is a range of distances outside of the brake zone that can be utilized to provide advance notice that the vehicle is approaching the braking zone;

determine when the vehicle is in either the braking zone or the warning zone;

set a counter to the time until the current state changes;

update the counter using an internal clock at defined intervals between receipt of messages;

estimate location of the vehicle when the traffic alerting signal is set to change state based on the counter, distance from traffic alerting signal and speed of the vehicle;

estimate when the vehicle will be in either the braking zone or the warning zone when the traffic alerting system is set to change state; and issue an appropriate alert based on which zone the vehicle is in.

2. The device of claim 1, wherein an alert for braking zone instructs the vehicle to apply the brakes.

3. The device of claim 1, wherein an alert for the warning zone instructs the vehicle to prepare to brake.

4. The device of claim 1, wherein the controller is further to determine when the vehicle is braking; and disable any alerts that have been issued.

5. The device of claim 4, wherein the controller is to determine when the vehicle is braking by determining when the vehicle is decelerating by greater than a defined amount.

6. The device of claim 1, wherein the controller is to determine the braking zone by calculating a stopping distance based on the current speed.

7. A traffic alerting and control device in communication with a vehicle, the device comprising a receiver to receive messages associated with a traffic alerting device, wherein the messages include information related to the traffic alerting device including location of the traffic alerting device and time until a current state of the traffic alerting device changes;

a location sensing module to determine location and direction of the vehicle;

a speed sensing module to determine the speed of the vehicle; and a controller to extract information from the messages;

determine when the messages are associated with the vehicle based on path of the vehicle and location of the traffic alerting device;

set a counter to the time until the current state of the traffic alerting system changes;

update the counter using an internal clock at defined intervals between receipt of messages;

estimate a stopping distance for the vehicle based on the current speed;

determine a braking zone based on the estimated stopping distance, wherein the braking zone is a range of distances from the traffic alerting device in which brakes can be applied to safely stop the vehicle;

predict location of the vehicle when the traffic alerting signal is set to change state based on the counter, distance from traffic alerting signal and speed of the vehicle;

predict when the vehicle will be in the braking zone; and issue a braking alert.

8. The device of claim 7, wherein the controller is further to determine when the vehicle is braking; and disable the braking alert.

9. The device of claim 8, wherein the controller is to determine when the vehicle is braking by determining when the vehicle is decelerating by greater than a defined amount.

10. The device of claim 7, wherein the controller is further to determine a warning zone outside of the braking zone that can be utilized to provide advance notice that the vehicle is approaching the braking zone.

11. The device of claim 10, wherein the warning zone is defined as distance the vehicle will travel at current speed for a defined amount of time, wherein the defined amount of time is associated with how much of an advance notice of the braking zone is desired.

12. A traffic alerting and control device in communication with a vehicle, the device comprising a receiver to receive messages associated with a traffic alerting device, wherein the messages include information related to the traffic alerting device including location of the traffic alerting device, current state of the traffic alerting device, and time until a current state of the traffic alerting device changes;

a location sensing module to determine location and direction of the vehicle;

a speed sensing module to determine the speed of the vehicle; and a controller to extract information from the messages;

determine when the messages are associated with the vehicle based on path of the vehicle and location of the traffic alerting device;

estimate a stopping distance for the vehicle based on the current speed;

determine a braking zone based on the estimated stopping distance, wherein the braking zone is a range of distances from the traffic alerting device in which brakes can be applied to safely stop the vehicle;

determine a warning zone outside of the braking zone that can be utilized to provide advance notice that the vehicle is approaching the braking zone;

when current state of the traffic alerting system is not a clear condition:

determine when the vehicle is in either the braking zone or the warning zone; and issue an appropriate alert; and when the current state of the traffic alerting system is a clear condition:

set a counter to the time until the current state of the traffic alerting system changes;

update the counter using an internal clock at defined intervals between receipt of messages;

estimate location of the vehicle when the traffic alerting signal is set to change state based on the counter, distance from traffic alerting signal and speed of the vehicle;

estimate when the vehicle will be in either the braking zone or the warning zone based on the estimated location; and issue an appropriate alert.

13. The device of claim 12, wherein when the current state of the traffic alerting system is not a clear condition the controller is to determine if the vehicle is in the braking zone;

if the vehicle is in the braking zone, issue a braking alert;

if the vehicle is not in the braking zone, determine if the vehicle is in the warning zone; and if the vehicle is in the warning zone, issue a warning alert.

14. The device of claim 12, wherein the controller is further to determine when the vehicle is braking, wherein the vehicle is deemed to be braking when it is determined that the vehicle is decelerating by greater than a defined amount; and set a braking flag.

15. The device of claim 14, wherein when the current state of the traffic alerting system is not a clear condition the controller is to determine if the vehicle is in the braking zone;

if the vehicle is in the braking zone, determine if the breaking flag is set;

if the breaking flag is not set, issue a braking alert;

if the vehicle is not in the braking zone, determine if the vehicle is in the warning zone; and if the vehicle is in the warning zone, issue a warning alert.

16. The device of claim 12, wherein when the current state of the traffic alerting system is a clear condition the controller is to determine when the estimated location of the vehicle when the traffic alerting signal is set to change has not passed the breaking zone;

determine if the estimated location of the vehicle is in the braking zone;

if the estimated location of the vehicle is in the braking zone, issue a braking alert;

if the estimated location of the vehicle is not in the braking zone, determine if the estimated location of the vehicle is in the warning zone; and if the estimated location of the vehicle is in the warning zone, issue a warning alert.

* * * * *